United States Patent [19]

Giffard

[11] 4,209,386

[45] Jun. 24, 1980

[54] METHOD AND APPARATUS FOR THE WET GRAVITY CONCENTRATION OF ORES

[75] Inventor: Philip J. Giffard, Southport, Australia

[73] Assignee: Mineral Deposits Limited, Southport, Australia

[21] Appl. No.: 853,751

[22] Filed: Nov. 21, 1977

[30] Foreign Application Priority Data

Nov. 22, 1976 [AU] Australia ..... PC8218

[51] Int. Cl.[2] ..... B03B 11/00

[52] U.S. Cl. ..... 209/459; 209/157; 209/499

[58] Field of Search ..... 209/211, 459, 458, 155, 209/157, 498, 497, 460, 499

[56] References Cited

U.S. PATENT DOCUMENTS

| | | | |
|---|---|---|---|
| 2,766,882 | 10/1956 | Cannon et al. | 209/157 |
| 3,379,310 | 4/1968 | Reichert | 209/498 |

FOREIGN PATENT DOCUMENTS

| | | | |
|---|---|---|---|
| 920368 | of 0000 | United Kingdom | 209/459 |

*Primary Examiner*—Robert Halper

*Attorney, Agent, or Firm*—Stevens, Davis, Miller & Mosher

[57] ABSTRACT

A method and apparatus for the wet gravity concentration of particulate ores in which a cascaded series of concentrators may be arranged in a matrix array from a basic triangular unit comprising a first concentrator for dividing a pulp stream into two sub-streams of differing concentration and a pair of subsidiary concentrators for respectively dividing the sub-streams, the subsidiary concentrator dividing the richer sub-stream being arranged to remove at least part of its enriched stratum without intruding substantially into its feed grade stratum while the subsidiary concentrator dividing the poorer sub-stream is arranged to remove at least part of its depleted stratum without intruding substantially into its feed grade stratum. The method and apparatus are described with reference to both tray and cone concentrators.

17 Claims, 7 Drawing Figures

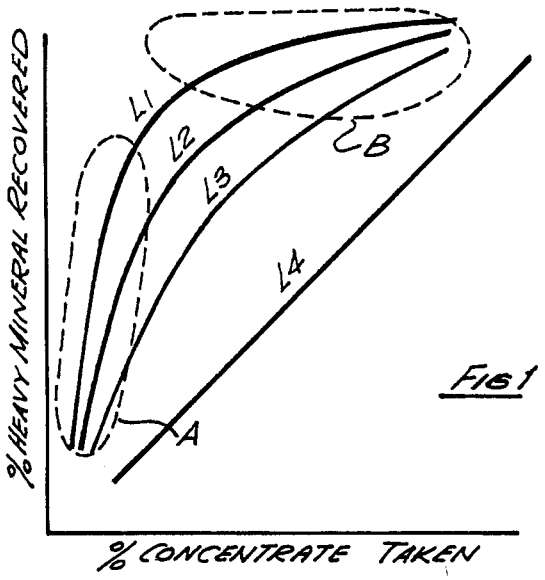
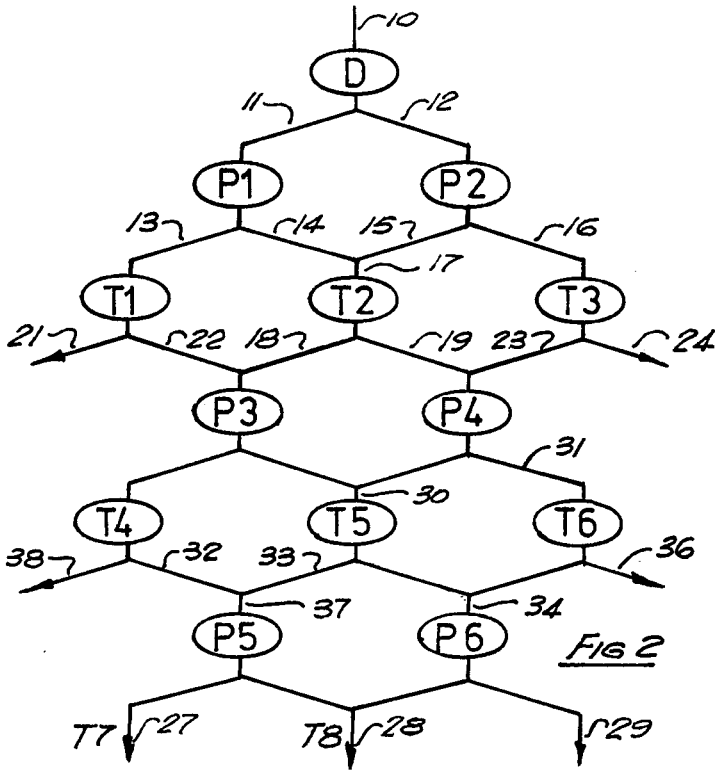
Fig. 2

METHOD AND APPARATUS FOR THE WET GRAVITY CONCENTRATION OF ORES

The present invention relates to the gravitational concentration of granular or particulate ores; the ore being treated in the form of a pulp (that is, a suspension of solid particles in water) wherein the required or value particles have a specific gravity higher than that of the remaining or unwanted particles.

The invention has been developed for use with conical concentrators and it is particularly well adapted for this type of concentrator. It will be appreciated, however, that the invention is not limited to this particular type of separator.

In a conical concentrator, a pulp stream flowing downwardly towards the apex region of a cone is brought into contact with a splitter which divides the stream into a concentrate sub-stream rich in value particles and a less concentrated or depleted sub-stream composed primarily of the unwanted particles or tailings. The same type of flow division can be achieved with tray concentrators where the pulp stream flows to a splitter along a path defined by two (usually convergent) side walls located on opposite sides of a flat and downwardly sloping floor.

It is generally found that the production of acceptable concentrates or tailings requires more than a single separation stage and it is well known to employ a cascaded series of gravitational separators wherein the concentrates or tailings from one separation stage flow downwardly to one or more subsequent stages. Previously known cascaded series concentrators have generally been directed to progressively obtaining an acceptable concentrate by successively dividing out a relatively small proportion of the flow as concentrates at each separation stage. As a result, the concentrators have operated at undesirably low efficiencies in that they were subject to high recirculating loads. That is to say, a substantial proportion of the material passing into the first stage of the concentrator series had to be recirculated through the system. In some cases the proportion of material or "middlings" being recirculated amounted to 30% of the total throughput of the apparatus.

A further disadvantage of concentrators generally is their tendency to operate progressively more inefficiently at higher loadings. This effect can best be illustrated by means of the diagrammatic graph forming FIG. 1 of the accompanying drawings. This graph shows the variation in the percentage of heavy mineral recovered when plotted against the percentage of concentrate taken from the separator for four different rates of loading. The load curves are indicated as L1, L2, L3, and L4, representing increasing material flow rates through the apparatus.

When operating at the highest throughput represented by curve L4, it will be seen that the separator is failing to produce a useful product since the curve is a straight line of unit gradient and any increase or decrease in the percentage of concentrates taken produces an identical increase or decrease in the percentage of heavy mineral recovered. In theory, a separator operating upon this load line would require all of its throughput to be recirculated. As the loading is reduced, the curves take a form in which they are substantially tangential to curve L4 over progressively less of their lengths.

The above results are experienced because a stream of pulp does not separate cleanly into a well defined layer of heavy or value particles surmounted by an equally well defined layer of unwanted particles. Instead, it is found that the flow divides progressively into three strata, a lower stratum rich in value particles, an upper stratum substantially depleted of value particles and an intermediate layer where transient and turbulent conditions maintain the quality of the material at approximately feed grade. As loadings are increased, the flow becomes progressively more turbulent with the result that the concentrated and depleted zones tend to disappear.

The most favourable operating region for any separator is upon a portion of a curve where the gradient is as far removed as possible from that of curve L4. It is therefore apparent that the most desirable regions within which to operate the separator would be in those two areas indicated as "A" and "B". If operating in region A only, the apparatus provides high grade concentrates but at the expense of producing a large quantity of undesirably high grade tailings which must be recirculated or treated in subsequent separation stages. On the other hand, a separator operating only in region B would produce acceptably low grade tailings but at the same time generate a large quantity of unacceptably low grade concentrates.

As concentrators operating in region A attempt to draw off a greater proportion of concentrates they intrude progressively further into the intermediate feed grade layer and the percentage of heavy mineral in the concentrate becomes progressively less as more concentrates are taken. That is, the operating point of the concentrator moves upwardly along its load line into a region where that curve is substantially tangential to the curve L4 with an accompanying increase in subsequent recirculating loads and a corresponding decline in efficiency. Conversely, the operating point of a concentrator functioning in only region B tends to move downwardly along its load line as it extracts a greater proportion of tailings.

It is an object of the present invention to provide a method and apparatus for the wet gravity concentration of particulate ores which will reduce the proportion of material previously requiring re-treatment for a predetermined degree of concentration.

According to the invention in one broad aspect, there is provided a method for the wet gravity concentration of particulate ores, comprising the steps of:

(a) stratifying a stream of ore pulp consisting of a mixture of concentrate particles and lighter tailings particles in water such that at least a portion of the concentrate particles become located at or near the bottom of the stream thereby to form a concentrate enriched stratum at the bottom of the stream, a concentrate depleted stratum at the top of the stream, and an intermediate stratum of approximately feed grade material;

(b) dividing the stream to remove at least part of the enriched stratum thereby to produce two sub-streams, one being richer in concentrates than the other;

(c) stratifying the sub-streams as aforesaid;

(d) dividing the richer sub-stream to remove at least part of its enriched stratum without intruding substantially into its feed grade stratum;

(e) dividing the poor sub-stream to remove at least part of its depleted stratum without intruding substantially into its feed grade stratum.

Preferably, a further step (f) is performed where the poorer stream resulting from step (d) is combined with the richer stream resulting from step (e) and this combined stream is further treated by repeating steps (a) to (f) as required.

According to a further broad aspect of the present invention, there is provided apparatus for performing the above described method comprising:

(a) means for stratifying a stream of ore pulp consisting of a mixture of concentrate particles and lighter tailings particles in water such that at least a portion of the concentrate particles become located at or near the bottom of the stream thereby to form a concentrate enriched stratum at the bottom of the stream and a concentrate depleted stratum at the top of the stream, and an intermediate stratum of approximately feed grade material;

(b) means for dividing the stream to remove at least part of the enriched stratum thereby to produce two sub-streams, one being richer in concentrates than the other;

(c) means for stratifying the sub-streams as aforesaid;

(d) means for dividing the richer sub-stream to remove at least part of its enriched stratum without intruding substantially into its feed grade stratum;

(e) means for dividing the poorer sub-stream to remove at least part of its depleted stratum without intruding substantially into its feed grade stratum.

A preferred embodiment of the invention will now be described, by way of example only, with reference to the accompanying drawings in which:

FIG. 1 is a qualitative graph showing the variation in the percentage of heavy mineral recovered plotted against the percentage of concentrate taken for a wet gravity separator operating at different rates of loading;

FIG. 2 is a diagrammatic illustration of a cascaded series of concentrators for performing the method of the present invention;

Figure 3:
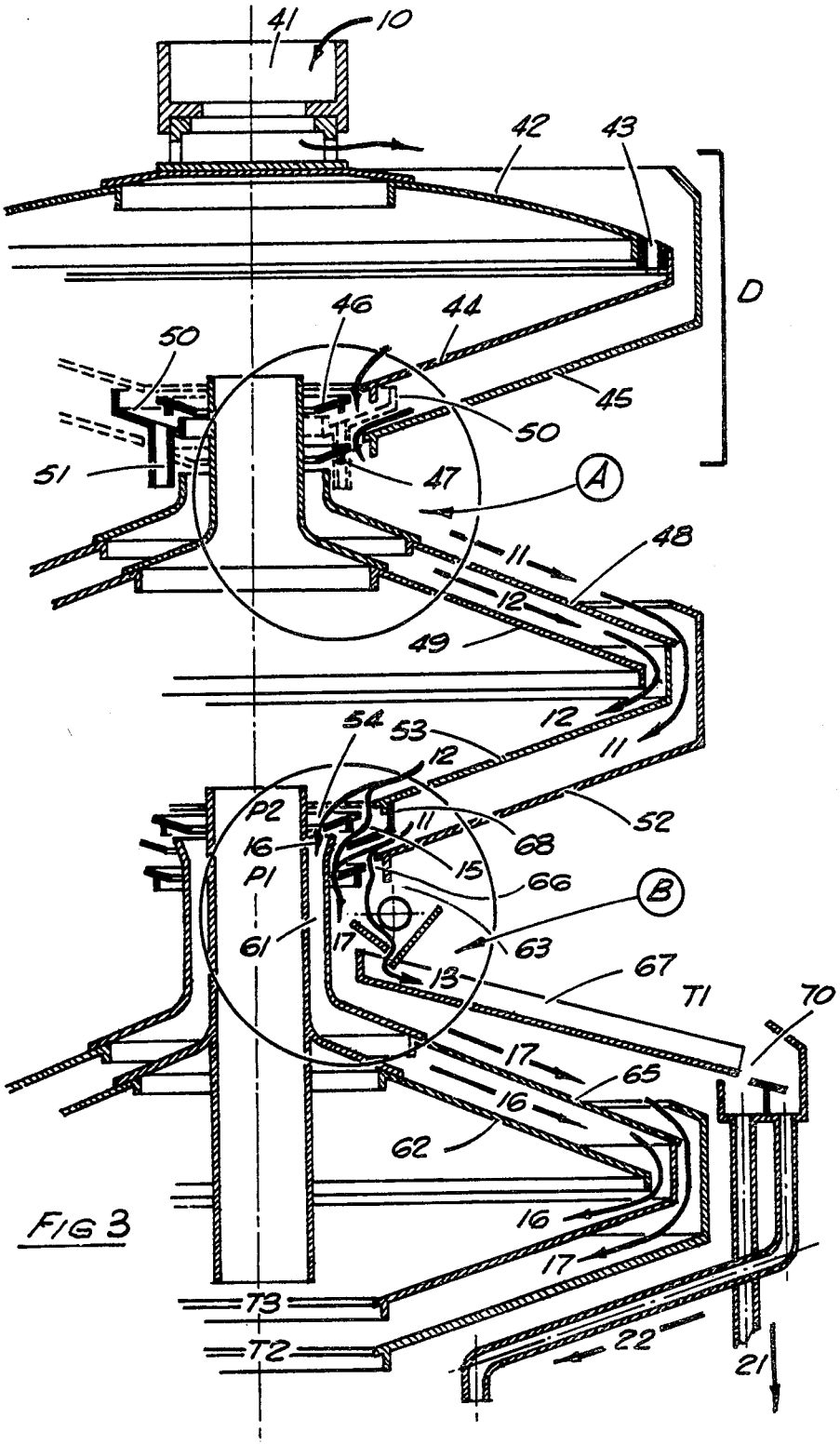
FIG. 3 is a sectional view of the upper part of a cascaded series of cone concentrators according to the invention.

Referring initially to FIG. 2 of the drawings, each lettered oval represents a concentration stage at which a stream of ore pulp is separated into two sub-streams, a rich or concentrated stream, in each case indicated as flowing downwardly to the left of the diagram, and a low grade or tailings stream, in each case indicated as flowing downwardly to the right of the diagram.

The concentrators themselves may be of any suitable type but preferably include a large proportion of the conical variety which are particularly suitable for the construction of a relatively compact series concentrator to be described hereinafter.

A stream of ore pulp 10 is fed to a first concentrator unit D which divides the main stream into two sub-streams 11 and 12 respectively richer and poorer in concentrate particles. The sub-stream 11 passes to a further concentrator indicated as P1 which divides the sub-stream into two further streams 13 and 14 which are again respectively richer and poorer than the average quality of the sub-stream 11. Similarly, the poorer quality sub-stream 12 is divided by separator P2 into richer and poorer streams 15 and 16 respectively.

In accordance with the invention, the separator P1 which accepts the more highly concentrated sub-stream 11 is adapted to divide the stream 11 to remove at least part of its enriched stratum without intruding substantially into its feed grade stratum. The separator P2, on the other hand, divides the poorer sub-stream 12 so as to remove at least part of its depleted stratum without intruding substantially into its feed grade stratum.

It will be appreciated from the foregoing, that the flows 14 and 15 will be of approximately equal quality and these streams may therefore be combined as shown for further treatment in a subsequent separator T2. This separator is merely required to divide the combined flow 17 into richer and poorer sub-streams 18 and 19 respectively so that subsequent separators P3 and P4 can operate on the flows in the same way as separators P1 and P2 respectively.

If further treatment is required in respect of streams 13 and 16, this may be provided by subsequent separators T1 and T3 which function in a similar manner to separators P1 and P2 respectively. That is to say, separator T1 divides stream 13 to remove at least part of its enriched stratum without intruding substantially into its feed grade stratum, thereby producing richer and poorer streams 21 and 22 respectively. At the same time, separator T3 divides stream 16 to remove at least part of its depleted stratum without intruding substantially into its feed grade stratum, thereby to produce richer and pocrer strams 23 and 24 respectively.

In the cascaded series illustrated in FIG. 2, streams 21 and 24 are considered respectively to be of sufficiently rich and poor quality to be bled from the apparatus. The remaining flows 22 and 23, being approximately of equal quality to flows 18 and 19 respectively, may be combined with these flows for further treatment in the cascaded series.

It will be apparent that the basic structural unit of the cascaded series illustrated is provided by cascaded separators of the D, P1, P2 triangle. This triangle relationship is repeated downwardly through the series, for example, by the T2, P3, P4 triangle or the subsequent T5, P5, P6 array. These subsequent units may not be identical with those preceding them but each separator in a given "P" pair will exhibit a selectivity towards the richer stratum of its feed stream if it is located on the left of the diagram, that is, given an odd numbered subscript, while its even numbered neighbour will be selectively dividing the poorer stratum of its respective feed stream.

An important characteristic exhibited by the particular cascaded series of concentrators illustrated in FIG. 2 is the fact that the flow proceeding downwardly through the series is being continuously depleted by the continual extraction of concentrate streams to the left of the array and streams of tailings to the right. The correspondingly reduced loadings imposed upon the subsequent separators in the series will then permit them to function upon a more efficient load line further displaced from curve L4 in FIG. 1. It will be apparent then that the separator series as a whole will be operating simultaneously in both regions A and B of FIG. 1; those individual separators on the left of the array functioning in region A while those on the right operate in region B. Continuing this analysis, the upper separators on the left side will operate on load lines closer to curve L4 in region A while the lower separators on the left of the array will be functioning more efficiently on load lines further removed from curve L4 in region A. Similarly, the upper separators on the right of the array will function upon load lines closer to curve L4 in region B while the lower separators on the right of the array will function more efficiently on load lines further removed from curve L4 in region B.

The continuous flow depletion which is possible with the present invention results in the lower separators being subject to progressively reduced loadings with a corresponding reduction in recirculating loads. Accordingly, the material leaving the exempliary array in streams 27, 28 and 29 will represent only a relatively small proportion of the total flow 10 entering the cascaded series. Flows 27 and 29 can be removed as acceptable concentrates and tailings respectively while the remaining flow 28 can be recirculated as middlings. The relatively minor contribution which these middlings make to the total flow 10 results in a recirculating load which is significantly less than conventional separation apparatus operating at an equivalent loading to achieve the same degree of ore concentration. Clearly, the degree to which the array is extended will depend upon the particular application.

It will be appreciated that the illustrated array of separators is not limited to a particular separator type, nor to the particular arrangement shown. For example, it is preferable that the initial flow separation at stage D is accomplished by a double cone concentrator in order to accommodate a relatively high rate of material flow. The remaining separators are preferably single cone concentrators with the exception of separators T1, T4 and any subsequent separators on the extreme left of the array. These latter concentrators can conveniently be of the tray variety since the amount of material to be handled is relatively small, being highly concentrated.

In one modification of the array which would be desirable when treating feed material of very high grade, the separator T3 can be omitted and the flow 16 conveyed directly to separator P4. At the same time, the tray T1 can be replaced with a cone concentrator in order to handle the increased loading more efficiently.

Having discussed the theory behind the present invention and illustrated a possible arrangement of concentrators into a cascaded series for performing the method of the present invention, we turn now to consider a particular apparatus for putting the method of the invention into operation.

Referring to FIGS. 3 to 6, the cascaded series of concentrators is generally indicated by reference 40 and is composed primarily of cone concentrators stacked co-axially in a vertical array. A stream of feed grade ore pulp is admitted to the apparatus at point 41 and flows downwardly and outwardly over the upper surface of a distribution cone 42. As the material flows over the distribution cone, the depth of the stream progressively decreases until it reaches the periphery 43 where approximately equal proportions of the feed grade stream are admitted onto the upper surfaces of two concentrator cones 44 and 45 respectively.

Figure 5:
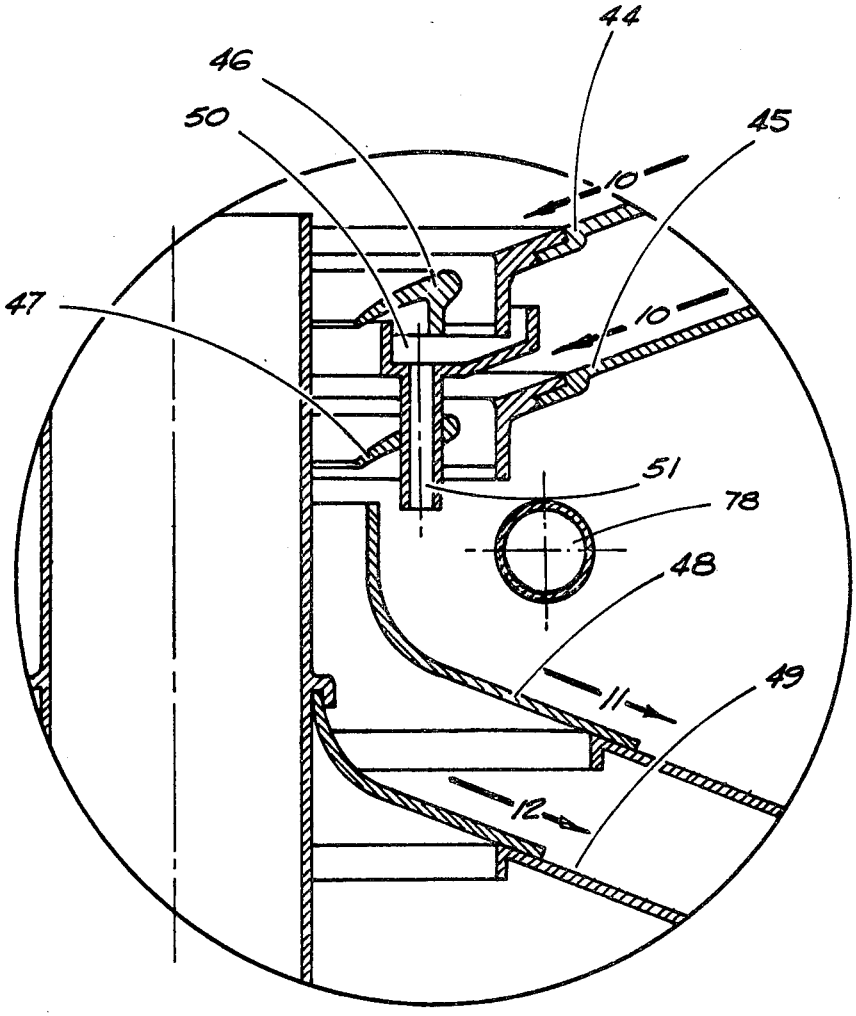
FIG. 5 is an enlarged view of that portion of the apparatus indicated by circle "A" in FIG. 3.
Figure 6:
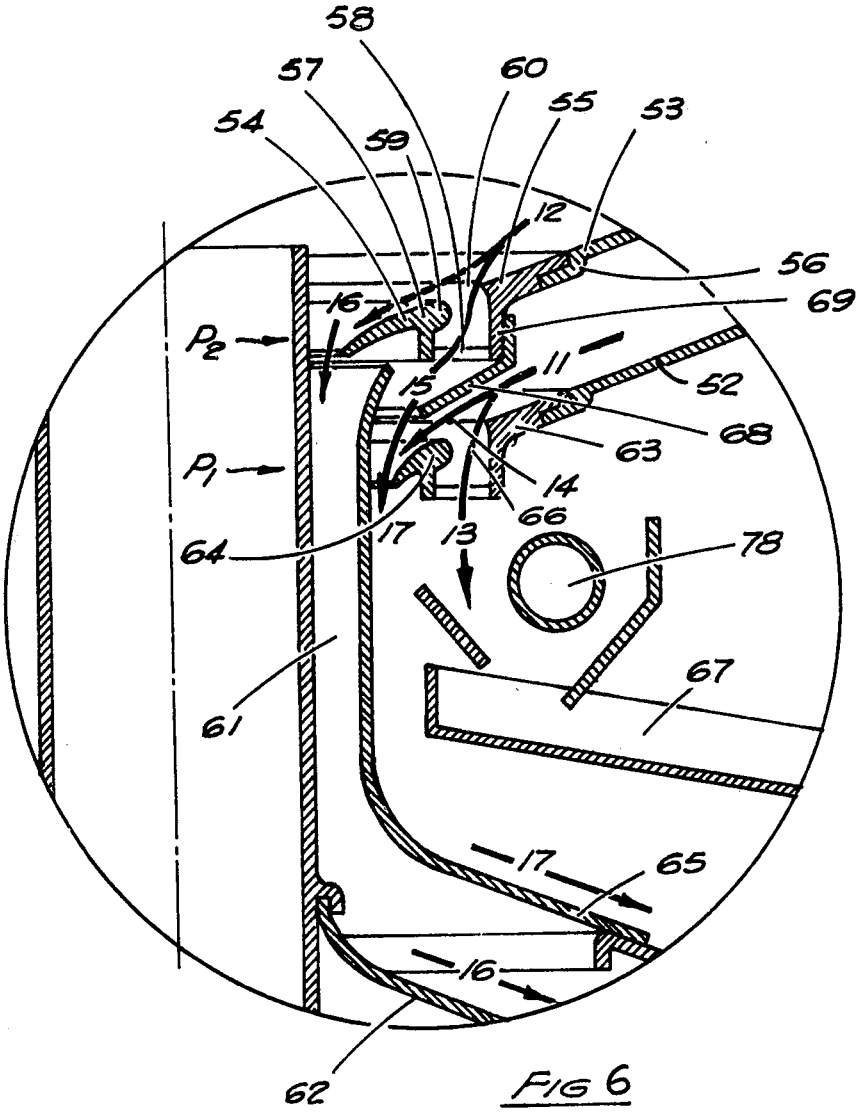
FIG. 6 is an enlarged view of that portion of the apparatus indicated by circle "B" in FIG. 3.

As the two streams approach the apex region of their respective cones, the depth of the streams progressively increases at a rate which permits at least a portion of the concentrate particles to remain at the bottom of the stream, thereby to form a concentrate enriched stratum at the stream bottom. Near the apex of the cones, as best shown in FIG. 5, the stratified streams come into contact with splitter rings 46 and 47 respectively which divide their respective flows into two sub-streams of which the richer or concentrate streams combine and flow onto the upper surface of a subsequent distribution cone 48, while the poorer or tailings stream flow over the splitter rings and combine to fall onto a lower distribution cone 49. The concentrates produced by the cone 44 pass into an annular trough 50 from which they flow through a plurality of circumferentially spaced downwardly extending tubes 51, past the tails flowing from cone 45 and onto the outer surface of cone 48 along with the concentrates produced by cone 45. This double cone concentrator corresponds with the concentrator "D" of FIG. 2, while the streams flowing onto cones 48 and 49 correspond with sub-streams 11 and 12 respectively.

The fanned sub-streams 11 and 12 are discharged from the cones 48 and 49 onto the upper surfaces of two concentric and downwardly converging cones 52 and 53, respectively. As best shown in the enlarged illustration provided by FIG. 6, the upper cone 53 is provided at its apex region with a splitter 54. The splitter 54 comprises an annular support flange 55 which engages with the lower edge 56 of the cone 53 so as to maintain a substantially continuous upper surface along which the ore stream 12 may flow, as well as serving to support a contoured inner splitter ring 57.

The ring 57 is adjustably attached to the flange 55 by several radial supporting arms 58. These arms can be secured to the flange 55 in any one of a number of circumferentially spaced positions of differing heights such that the elevation of the ring 57 can be varied by rotating it relative to the flange 55. In this way, the contoured leading edge 59 of the ring 57 can be made to confront the flow passing over the flange 55 at any one of a number of different angles.

The sub-stream 12, flowing over the cones 53 and flange 55 will strike the leading edge 59 of the splitter and divide into two streams of differing concentration depending upon the particular relative positions of the ring 57 and flange 55. It will be apparent that the cones 49 and 53, together with the associated splitter 54 corresponds with the concentrator P2 of FIG. 2. The relative positions of the ring 57 and the flange 55 are therefore selected such that the impingement of the flow onto the contoured surface 59 divides the sub-stream 12 to remove at least part of its depleted stratum without intruding substantially into its feed grade stratum, which depleted stratum continues over the upper surface of the ring 57.

The more concentrated stream 15 flows downwardly through an annular aperture 60 between the ring 57 and flange 55, the flow path being substantially unaffected by the support arms 58, while the less concentrated tailings stream 16 flows over the ring 57 and into an annular passage 61 from which it flows onto the upper surface of a subsequent distribution cone 62.

The sub-stream 11 decending cone 52 encounters a similar splitter 63 which divides the flow into two streams of differing concentration depending upon the position of the splitter ring 64 relative to the oncoming flow. Since the cones 48 and 52, together with the associated splitter 63 correspond with the concentrator P1 of FIG. 2, the splitter 63, although basically similar to splitter 54, is adjusted such that the impingement of the sub-stream 11 onto the contoured leading surface of the splitter ring 64 divides the flow so as to remove at least part of its enriched stratum without intruding substantially into its feed grade stratum. The more concentrated stream 13 flows downwardly through aperture 66 onto one or more separation trays 67 for a further stage of concentration. The tray 67 corresponds to the separator T1 in FIG. 2. The less concentrated stream 14 passes over the splitter ring 64 and onto an underlying distribution cone 65, together with the concentrate stream 15 from the overhead separator P2. The combined streams being indicated by reference 17.

In order to effect the required combination of streams 14 and 15, the P2 splitter 54 is provided with a downwardly extending annular deflector 68 which is part-conical in form and attached to a generally cylindrical flange 69 depending from the splitter support flange 55. The deflector 68 extends beneath the aperture 60 to direct the concentrated stream 15 issuing therefrom into the tailings stream 14 produced by the lower, P1 splitter 63, at the same time preventing the concentrated stream 15 from contaminating the more highly concentrated stream 13 falling onto the separation tray 67 from the lower splitter 63.

As mentioned above, the separation tray 67 corresponds with separator T1 in FIG. 2 and it is therefore adjusted to separate a relatively small proportion of concentrates which pass away from the apparatus through aperture 70 as a final concentrate stream 21. The tailings stream 22 may be recirculated through the apparatus but is preferably combined for further treatment with the subsequently generated, similar quality flow 18 as previously described.

The flows 16 and 17 proceed along distribution cones 62 and 65 respectively and onto their associated concentration cones 71 and 72. The cones 71 and 72 contain splitters which are similar to the previously described splitters 54 and 63, corresponding to separators T3 and T2 respectively. The T3 splitter of cone 71 is therefore similar to the P2 splitter of cone 53 in that it is adjusted to divide the stream 16 to remove at least part of its depleted stratum without intruding substantially into its feed grade stratum and the resulting concentrate stream 23 mixes with the tailings stream 19 and T2 cone 72 in the same manner as the P1, P2 flow combination described with particular reference to FIG. 6.

The combined flow then proceeds along a subsequent distribution cone (not shown) for further treatment in separator P4 as required, while the T3 tailings flow 24 into an axial conduit 76 by which it is removed from the apparatus.

Figure 4:
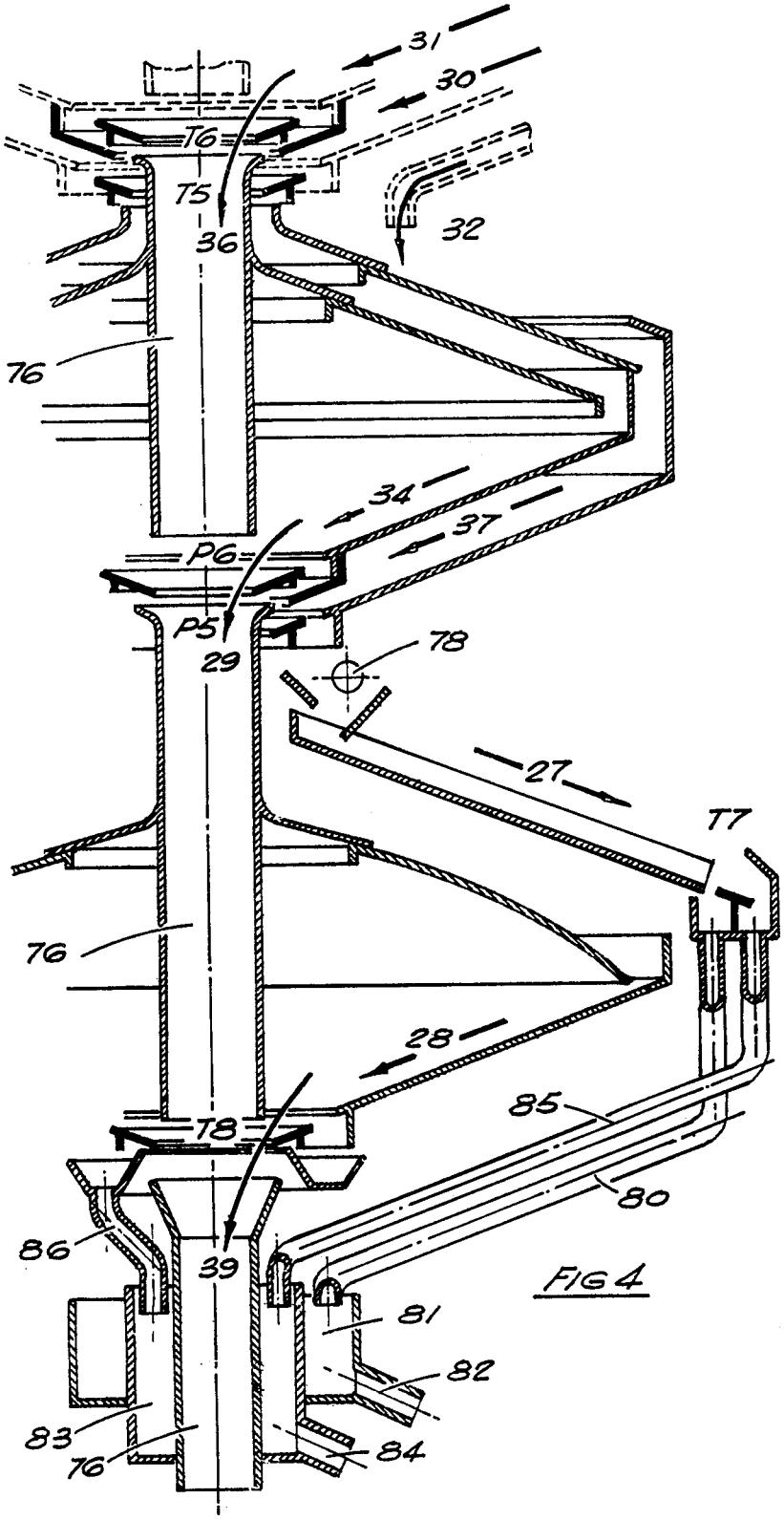
FIG. 4 is a sectional view of the lower part of the cascaded series of FIG. 3.

The lower part of the cascaded series of co-axial concentrators is illustrated in FIG. 4 which shows the location of the T5, T6, P5 and P6 separators. For simplicity, the P3 and P4 separator pair and associated tray separator T4 have been omitted but it will be appreciated that these are substantially identical with the P1, P2, T1 combination previously described.

Fluid flow paths through the lower part of the apparatus can be identified from FIG. 2 by corresponding reference numerals, as in the case of the upper concentration stages. In the illustrated apparatus, however, streams 27 and 28 are each subjected to a further concentration stage by additional separators T7 and T8 respectively. Tailings 39 from separator T8 combine with those from separators T3, T6 and P6 and flow away from the apparatus through conduit 76. Concentrates 80 from separator T7 flow into an annular trough 81 where they combine with the concentrates from the T1 and T4 separators to leave the apparatus through conduit 82. A further trough 83 discharges middlings through conduit 84 for recirculation through the apparatus. The middlings comprise the tailings from separators T7 and T8 which flow into trough 83 through conduits 85 and 86 respectively.

As the material flowing through the apparatus is progressively depleted it may become necessary to dilute the flows with water in order to maintain an acceptably fluid stream. Accordingly, water outlets 78 are conveniently positioned to admit water as required.

Figure 7:
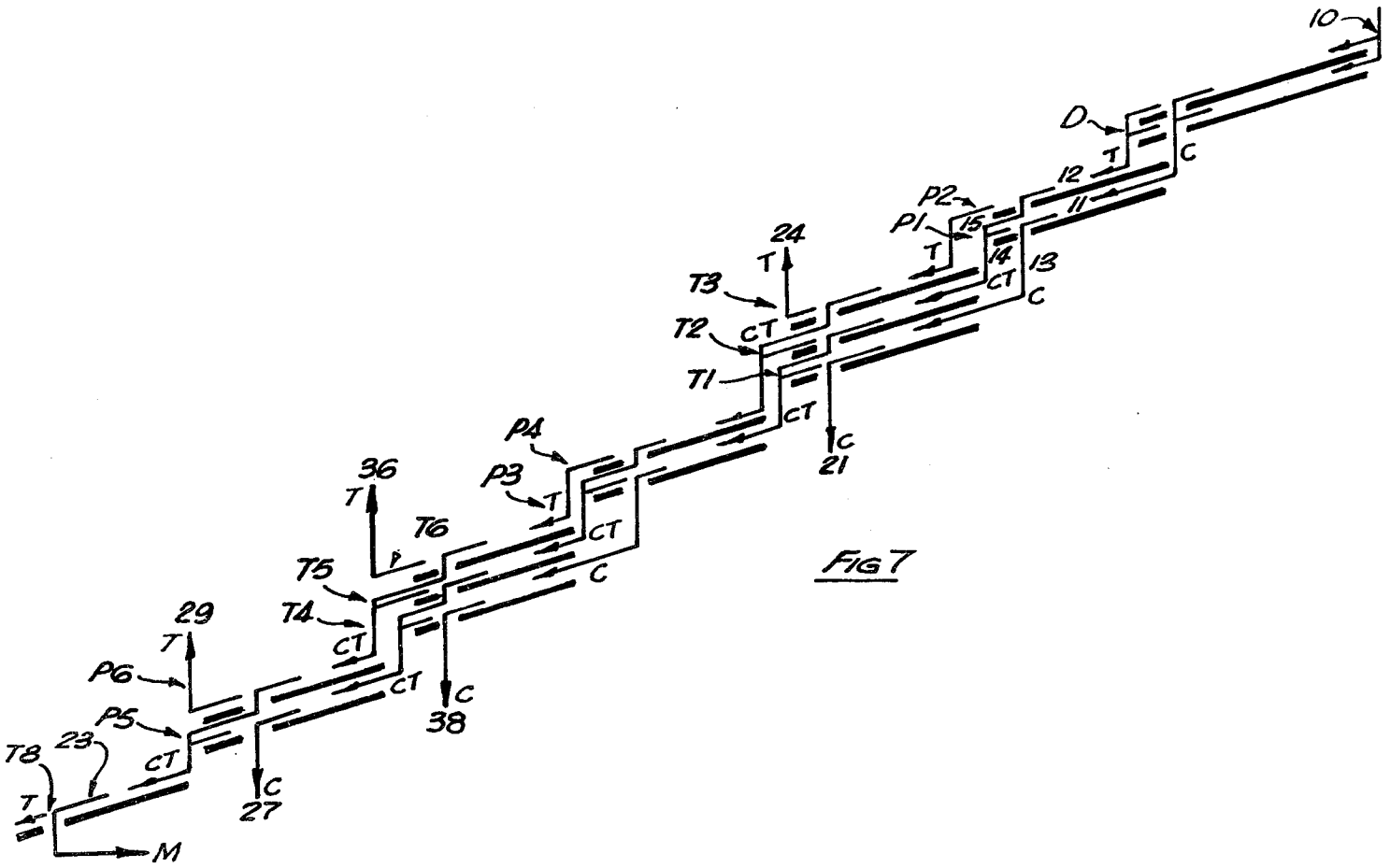
FIG. 7 is a diagrammatic illustration of a cascaded series of tray concentrates according to the invention.

The invention may also be embodied in a cascaded series of tray concentrators and a diagrammatic illustration of such an array is shown in FIG. 7. The various streams and concentrators may be identified from FIG. 2 with the exception of T8 which divides stream 28 into a final tailings stream T and a middlings stream M. Each tray may employ any suitable form of splitter.

Although the invention has been described with reference to specific arrays of concentrators and a particular apparatus for reproducing this array, it will be appreciated that the invention can be embodied in many other forms without departing from the scope of the inventive concept.

The claims defining the invention are as follows:

1. A method for the wet gravity concentration of particulate ores, comprising the steps of:

(a) stratifying a stream of ore pulp consisting of a mixture of concentrate particles and lighter tailings particles in water such that at least a portion of the concentrate particles become located at or near the bottom of the stream thereby to form a concentrate enriched stratum at the bottom of the stream, a concentrate depleted stratum at the top of the stream, and an intermediate stratum of approximately feed grade material;

(b) dividing the stream to produce two sub-streams, one being richer in concentrates than the other;

(c) stratifying each of the richer and poorer sub-streams such that at least a portion of the concentrate particles in each becomes located at or near the bottom of the sub-stream to thereby form a concentrate enriched stratum at the bottom of the sub-stream, a concentrate depleted stratum at the top of the sub-stream, and an intermediate stratum of approximately feed grade material;

(d) dividing the richer sub-stream to remove at least part of its enriched stratum without intruding substantially into its feed grade stratum;

(e) dividing the poorer sub-stream without prior comingling of said poorer sub-stream with other poorer sub-streams to remove at least part of its depleted stratum without intruding substantially into its feed grade stratum.

2. A method as defined in claim 1 including the further step of:

(f) combining the poorer stream resulting from step (d) with the richer stream resulting from step (e) and then repeating steps (a) to (f) using the output of step (f) in a preceding series of steps (a) to (f) as the ore pulp input for step (a) in a succeeding series of steps (a) to (f).

3. A method as defined in claim 1 wherein at least one of the steps (b), (d) or (e) is performed by a cone concentrator.

4. A method as defined in claim 1 wherein at least one of the steps (b), (d), or (e) is performed by a tray concentrator.

5. Apparatus for the wet gravity concentration of ores comprising:

(a) means for stratifying a stream of ore pulp consisting of a mixture of concentrate particles and lighter tailings particles in water such that at least a portion of the concentrate particles become located at or near the bottom of the stream thereby to form a concentrate enriched stratum at the bottom of the stream and a concentrate depleted stratum at the top of the stream, and an intermediate stratum of approximately feed grade material;

(b) means for dividing the stream to produce two sub-streams, one being richer in concentrates than the other;

(c) means for stratifying each of the richer and poorer sub-streams such that at least a portion of the concentrate particles in each becomes located at or near the bottom of the sub-stream to thereby form a concentrate enriched stratum at the bottom of the sub-stream, a concentrate depleted stratum at the top of the substream, and an intermediate stratum of approximately feed grade material;

(d) means for dividing the richer sub-stream to remove at least part of its enriched stratum without intruding substantially into its feed grade stratum;

(e) means for dividing the poorer sub-stream without prior comingling of said poorer sub-stream with other poorer sub-streams to remove at least part of its depleted stratum without intruding substantially into its feed grade stratum.

6. Apparatus as defined in claim 5 wherein at least one of the dividing means comprises a cone concentrator.

7. Apparatus as defined in claim 6 wherein said cone concentrator includes an annular, vertically adjustable splitter ring adjacent its apex.

8. Apparatus as defined in claim 6 wherein both said means for dividing said sub-streams respectively comprise one of a pair of substantially co-axial cone concentrators having their axes substantially vertical, upper and lower splitters located at the apex region of the upper and lower cones respectively, each splitter being adapted to divide a wet stream of particulate ore flowing downwardly over the upper surface of the respective cone into a richer stream which flows through one or more apertures and a poorer stream which flows over the splitter away from said one or more apertures, the upper splitter being arranged to divide the poorer sub-stream while the lower splitter is arranged to divide the richer sub-stream.

9. Apparatus as defined in claim 8 including means for combining the poorer stream resulting from the division of the richer sub-stream with the richer stream resulting from the division of the poorer sub-stream, said combining means comprising a deflector located beneath the one or more apertures of the upper splitter to direct the richer stream from the upper cone into the poorer stream of the lower cone.

10. Apparatus as defined in claim 5 further including means for combining the poorer stream resulting from the division of the richer sub-stream with the richer stream resulting from the division of the poorer sub-stream.

11. Apparatus as defined in claim 10 including:

(a) second-order means for stratifying and dividing the combined stream such that at least a portion of the concentrate particles become located at or near the bottom of the stream thereby to form a concentrate enriched stratum at the bottom of the stream and a concentrate depleted stratum at the top of the stream, and an intermediate stratum of approximately feed grade material to remove at least part of its enriched stratum thereby to produce two second-order sub-streams, one being richer in concentrates than the other;

(b) second-order means for dividing the richer second-order sub-stream to remove at least part of its enriched stratum without intruding substantially into its feed grade stratum;

(c) second-order means for dividing the poorer second-order sub-stream to remove at least part of its depleted stratum without intruding substantially into its feed grade stratum.

12. Apparatus as defined in claim 11 including second-order means for combining the poorer stream resulting from the division of the richer second-order sub-stream with the richer stream resulting from the division of the poorer second-order sub-stream.

13. Apparatus as defined in claim 12 wherein said means for dividing and said second order means for dividing comprise cone concentrators disposed in a cascaded series array.

14. Apparatus as defined in claim 13 including at least one tray concentrator for concentrating the richer stream resulting from the division of the richer sub-stream.

15. Apparatus as defined in claim 14 further including at least one tray concentrator for concentrating the richer stream resulting from the division of the richer second-order sub-stream.

16. Apparatus as defined in claim 12 wherein said means for dividing and said second-order means for dividing comprise tray concentrators disposed in a cascaded series array.

17. Apparatus as defined in claim 5 wherein at least one of the dividing means comprises a tray concentrator.

* * * * *